US008737902B2

(12) United States Patent
Igarashi

(10) Patent No.: US 8,737,902 B2
(45) Date of Patent: May 27, 2014

(54) PRINTING APPARATUS, CONTROL METHOD OF PRINTING APPARATUS, AND STORAGE MEDIUM

(75) Inventor: Hiroya Igarashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 13/169,203

(22) Filed: Jun. 27, 2011

(65) Prior Publication Data

US 2012/0003023 A1 Jan. 5, 2012

(30) Foreign Application Priority Data

Jul. 1, 2010 (JP) ..... 2010-151227

(51) Int. Cl.
*G03G 15/00* (2006.01)
*B65H 33/04* (2006.01)

(52) U.S. Cl.
USPC ..... 399/382; 270/58.32

(58) Field of Classification Search
USPC ..... 399/382; 270/58.32
IPC ..... G03G 15/655
See application file for complete search history.

(56) References Cited

U.S. PATENT DOCUMENTS

2010/0019436 A1* 1/2010 Nakagawa et al. ..... 270/58.32

FOREIGN PATENT DOCUMENTS

JP 2003040517 A 2/2003

* cited by examiner

*Primary Examiner* — Daniel J Colilla
*Assistant Examiner* — John M Royston
(74) *Attorney, Agent, or Firm* — Canon USA, Inc., IP Division

(57) ABSTRACT

A printing apparatus to attach at least one tab sheet to a print document discharged by performing a print job may include a specifying unit and a control unit. N is integer of 2 or more and N tab sheets constitute one set of tab sheets. The specifying unit specifies a number M (M is an integer of 1 or more) of the tab sheet specified to be attached to the print document corresponding to one print document set in the print job. The control unit performs control so as to discharge a surplus tab sheet of a number corresponding to a difference between the N and the M after discharging an M-th tab sheet and before discharging a remaining print document to be discharged by performing the print job, during printing of the print document corresponding to the one print document set in the print job.

6 Claims, 10 Drawing Sheets

| | | | | C | | | | D | |
|---|---|---|---|---|---|---|---|---|---|
| | PLAIN SHEET | → | TAB SHEET | → | DISCHARGE OF REMAINING TAB SHEET(S) | → | PLAIN SHEET | → | PLAIN SHEET IN NEXT SET |
| SWITCHING OF SHEET FEED STAGES | | ○ | | × | | ○ | | × | |
| SWITCHING OF SHEET DISCHARGE STAGES | | × | | ○ | | ○ | | × | |

| | A | | | | B | | |
|---|---|---|---|---|---|---|---|
| | PLAIN SHEET | → | TAB SHEET | → | PLAIN SHEET | → | DISCHARGE OF REMAINING TAB SHEET(S) | → | PLAIN SHEET IN NEXT SET |
| SWITCHING OF SHEET FEED STAGES | | ○ | | ⊙ | | ○ | | ⊙ | |
| SWITCHING OF SHEET DISCHARGE STAGES | | × | | × | | ○ | | ⊙ | |

PRINTING APPARATUS, CONTROL METHOD OF PRINTING APPARATUS, AND STORAGE MEDIUM

BACKGROUND OF THE INVENTION

1. Field of the Invention

The present invention relates to a printing apparatus, a control method of the printing apparatus, and a storage medium.

2. Description of the Related Art

Conventionally, there have been proposed a copying machine and a printer including a tab sheet insertion mode capable of inserting tab sheets (also referred to as "index sheets") at predetermined positions in an output stack constituted by sheets having a normal size to generate a document containing headlines and divided chapters. Tab sheets used in such printing are prepared as one set constituted by a combination of a predetermined number of tab sheets. For example, for a five tab sheet set, one set is constituted by five tab sheets.

However, when five tab sheets are placed though only two positions are specified as tab insertion positions, three of them become surplus sheets. Therefore, a problem arises that, if a next document set or a next job starts to be printed without removing the surplus tab sheets, the next print output has tab positions different from those in the previous print output.

However, it is bothersome for a user to remove these surplus tab sheets in advance and then reset tab sheets for the next printing. As an attempt to improve this situation, Japanese Patent Application Laid-Open No. 2003-40517 discusses a technique of automatically discharging surplus tab sheets, for example, at a break between printing of document sets or jobs to thereby enable printing of tab sheets from the head thereof in the next set of documents or the next job.

However, this technique may require additional operations for switching the sheet feed stages and switching between two-sided and one-side modes when the printing apparatus discharges surplus tab sheets.

For example, as illustrated in FIG. 10, it is assumed that surplus tab sheets are discharged after completion of printing of one set of documents 1001. In this case, plain sheets are fed after the sheet feed stage is switched at timing A. Then, after three plain sheets are fed, the sheet feed stage is again switched to discharge the surplus tab sheet. Then, after the surplus tab sheets are fed, the sheet feed state is further switched at timing B to feed plain sheets for a next set of documents.

When the sheet feed stages are switched in this way, some time period is to be taken between conveyance of plain sheets and conveyance of a tab sheet, for changing the sheet conveyance path and preventing occurrence of a jam. Therefore, an increase in the number of times of switching the sheet feed stages results in prolonged time until completion of the printing operation by the secured time, thereby reducing the productivity of the printing apparatus.

Further, when plain sheets are printed in the two-sided printing mode, a discharge of surplus tab sheets requires switching the conveyance path used in two-side printing to the conveyance path used in one-sided printing. As a result, the interval time of conveyance between sheets is increased caused by the switching, thereby reducing the productivity of the printing apparatus.

In this way, switching of the sheet feed stages and switching between two-sided and one-side modes lead to a deterioration in the productivity of the printing apparatus. Especially, when a sheet before or after a discharge of a surplus tab sheet is not a tab sheet, it becomes necessary to switch the sheet feed stages and switch the printing mode between two-sided and one-side modes, resulting in the deterioration in productivity of the printing apparatus.

SUMMARY OF THE INVENTION

According to an aspect of the present invention, a printing apparatus configured to attach at least one tab sheet to a print document discharged by performing a print job, wherein N is integer of 2 or more and N tab sheets constitute one set of tab sheets, the printing apparatus comprising: a specifying unit configured to specify a number M (M is an integer of 1 or more) of the tab sheet specified to be attached to the print document) corresponding to one print document set in the print job; and a control unit configured to perform control so as to discharge a surplus tab sheet of a number corresponding to a difference between the N and the M after discharging an M-th tab sheet and before discharging a remaining print document to be discharged by performing the print job, during printing of the print document corresponding to the one print document set in the print job.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
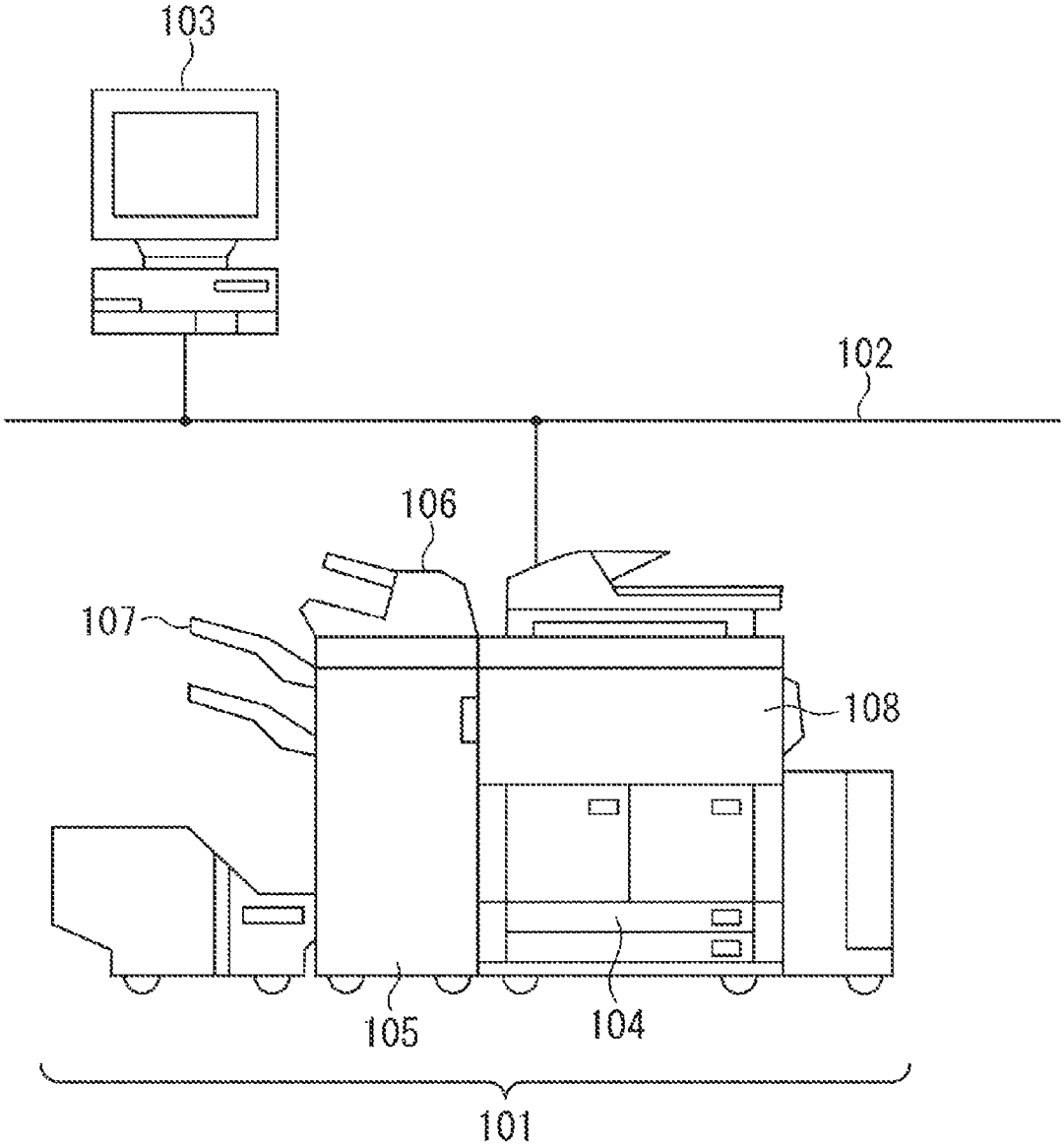
FIG. 1 is a block diagram illustrating a configuration of a printing system.

FIG. 1 is a block diagram illustrating a configuration of a printing system according to a first exemplary embodiment. Referring to FIG. 1, the printing system includes a printing apparatus 101 and a computer terminal 103, which are connected to a network 102.

The printing apparatus 101 includes a sheet processing apparatus 105 including a plurality of sheet feeders 104 and a plurality of sheet discharge trays 107. The computer terminal 103 transmits print data generated by an application to the printing apparatus 101. The printing apparatus 101 generates image data based on the image data received from the computer terminal 103, prints it on a sheet fed from the sheet feeder 104 which functions as a sheet feeding unit, and discharges the printed sheet to the sheet discharge tray 107.

The printing apparatus 101 according to the present exemplary embodiment includes an inserter 106, which functions as a sheet feeding unit for feeding tab sheets, and further, is configured to be able to discharge tab sheets fed from the inserter 106 to the sheet discharge tray 107. The inserter 106 functions as a sheet feed stage for feeding tab sheets, and the sheet feeder 104 functions as a sheet feed stage for feeding sheets to be printed.

Further, tab sheets can be also set on the sheet feeder 104. The printing apparatus 101 further includes a printer unit 108 which performs print processing. The sheet feeder 104 or the inserter 106 holds one stack of a plurality of tab sheets having different tab positions as one set, and separates and feeds the held tab sheets one by one.

Figure 2:
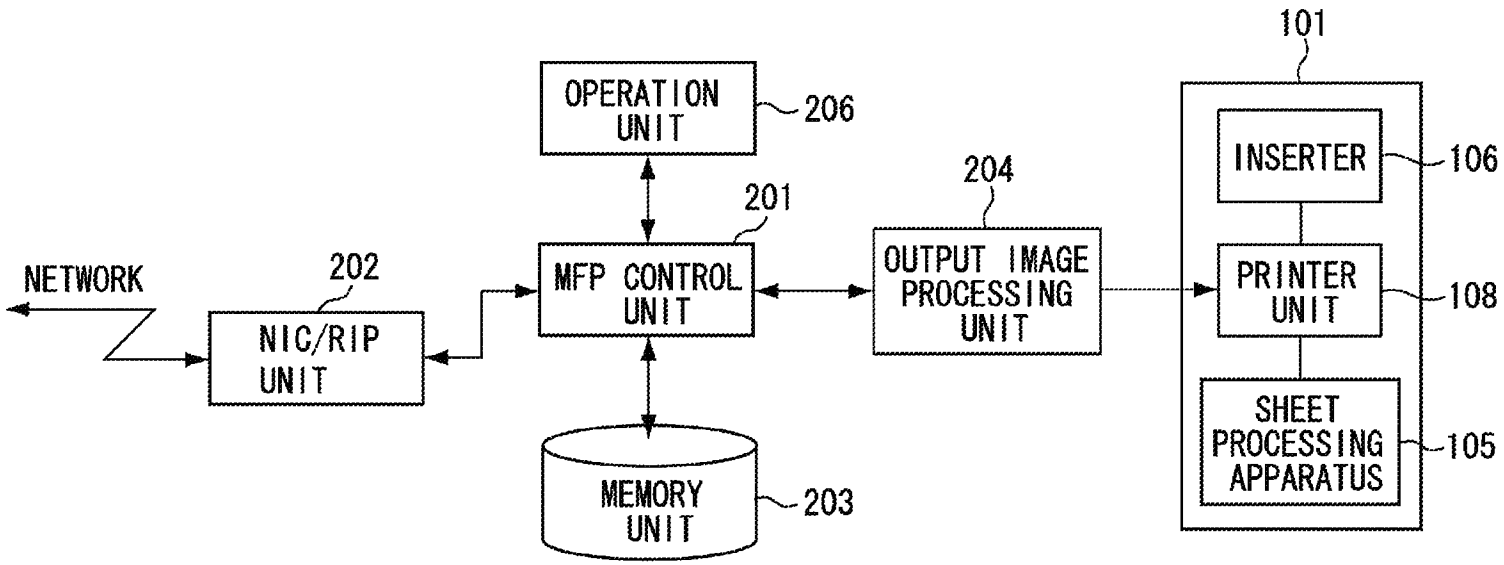
FIG. 2 is a block diagram illustrating a configuration of a printing apparatus illustrated in FIG. 1.

FIG. 2 is a block diagram illustrating a configuration of the printing apparatus 101 illustrated in FIG. 1. The present exemplary embodiment employs a multi function peripheral (MFP) as an example of the printing apparatus.

Referring to FIG. 2, an MFP control unit 201 includes a central processing unit (CPU), a read only memory (ROM) storing various programs to be read by the CPU, and a random access memory (RAM) serving as a work memory of the CPU. The CPU executes the programs stored in the ROM, whereby the MFP control unit 201 performs overall control of the MFP.

When print data is input from the computer terminal 103 via the network 102, a network interface card/raster image processor (NIC/RIP) unit 202 receives the print data (mainly, Page Description Language (PDL) data) input via the network 102. Then, the NIC/RIP unit 202 interprets the received print data, and performs a RIP processing of the data by using a memory unit 203.

Next, the print data rasterized by the NIC/RIP unit 202 is transmitted to the MFP control unit 201. The MFP control unit 201 serves as a traffic controller to control input data and output data.

Further, the MFP control unit 201 stores the image data transmitted from the NIC/RIP unit 202 in the memory unit 203 at first. The multi-valued image data is temporarily stored in the memory unit 203, and is transmitted to an output image processing unit 204 when it is read as necessary.

The output image processing unit 204 transmits the received multi-valued image data to the printer unit 108 after applying image processing for printing. The printer unit 108 feeds sheets, and sequentially forms images on the sheets based on the print data transmitted from the output image processing unit 204.

Further, an operation unit 206 controls a touch panel display included in the MFP. More specifically, the operation unit 206 controls operations of functions such as the copy function and the facsimile function, and operations of various settings of the MFP, which are instructed by a user through the touch panel display, and outputs the results thereof to the MFP control unit 201. The present exemplary embodiment is described based on an example that the printer unit 108 is controlled by the MFP control unit 201, but the printer unit 108 may individually have a controller different from the MFP control unit 201, and this controller may control the printer unit 108.

Figure 3:
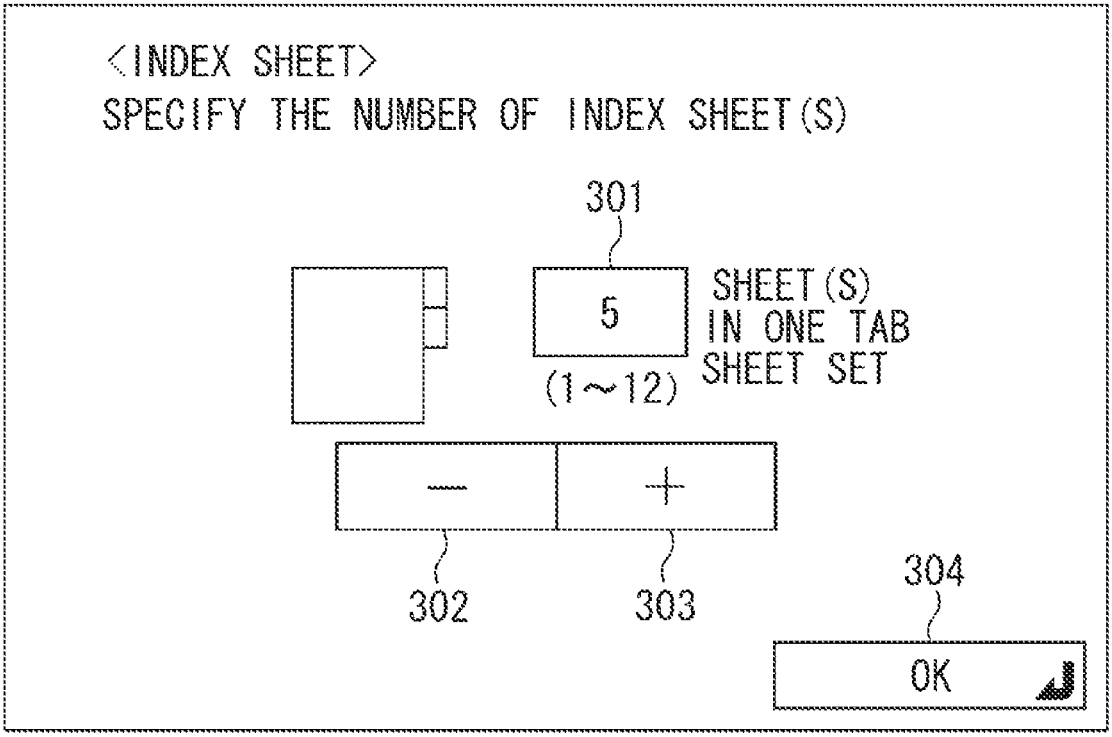
FIG. 3 illustrates an example of a user interface (UI) displayed on an operation unit illustrated in FIG. 2.

Registering processing of tab sheets in the printing apparatus according to the present exemplary embodiment will be described below. When a user places sheets on the sheet feeder 104 of the printing apparatus 101, the user operates the operation unit 206 to display a screen for prompting the user to specify the type of the sheets. Especially, when tab sheets are placed on the sheet feeder 104, a screen on which a user can specify the number of tab sheets to constitute one tab sheet set is displayed as illustrated in FIG. 3.

An area 301 displays the number of tab sheets to constitute one tab sheet set which a user is to specify. A minus key 302 and a plus key 303 allow a user to reduce and increase the number of tab sheets to constitute one tab sheet set. Pressing an OK key 304 finalizes the number of tab sheets to constitute one tab sheet set specified on the printing apparatus 101.

The discharging processing of surplus tab sheets in the printing apparatus according to the present exemplary embodiment will be described below. If the number of tab sheets to be used in one document set in a print job is not an integral multiple of the number of tab sheets constituting one tab sheet set placed on the printing apparatus 101, sequential execution of printing of the next document set results in insertions of the tab sheets at incorrect positions. Therefore, the surplus tab sheets needs to be discharged before the next document set starts to be printed. It is desirable that the discharge destination is a tray different from the tray to which printed documents are discharged. How the present exemplary embodiment controls a discharge of surplus tab sheets will be described below.

The setting processing of a job using tab sheets in the printing apparatus according to the present exemplary embodiment will be described below. In the present exemplary embodiment, a user sets a job using tab sheets on the computer terminal 103 with use of a printer driver.

Figure 4:
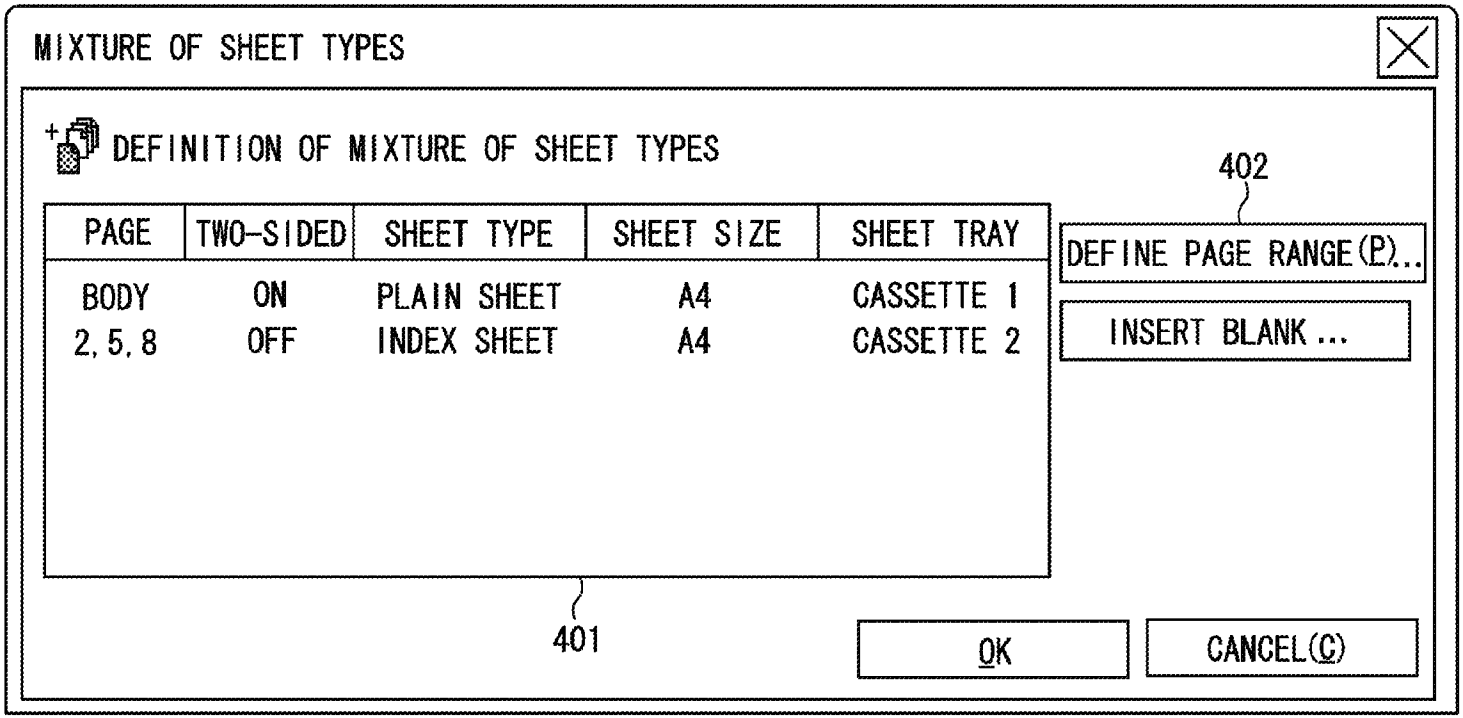
FIG. 4 illustrates a UI displayed on a computer terminal illustrated in FIG. 1.
Figure 5:
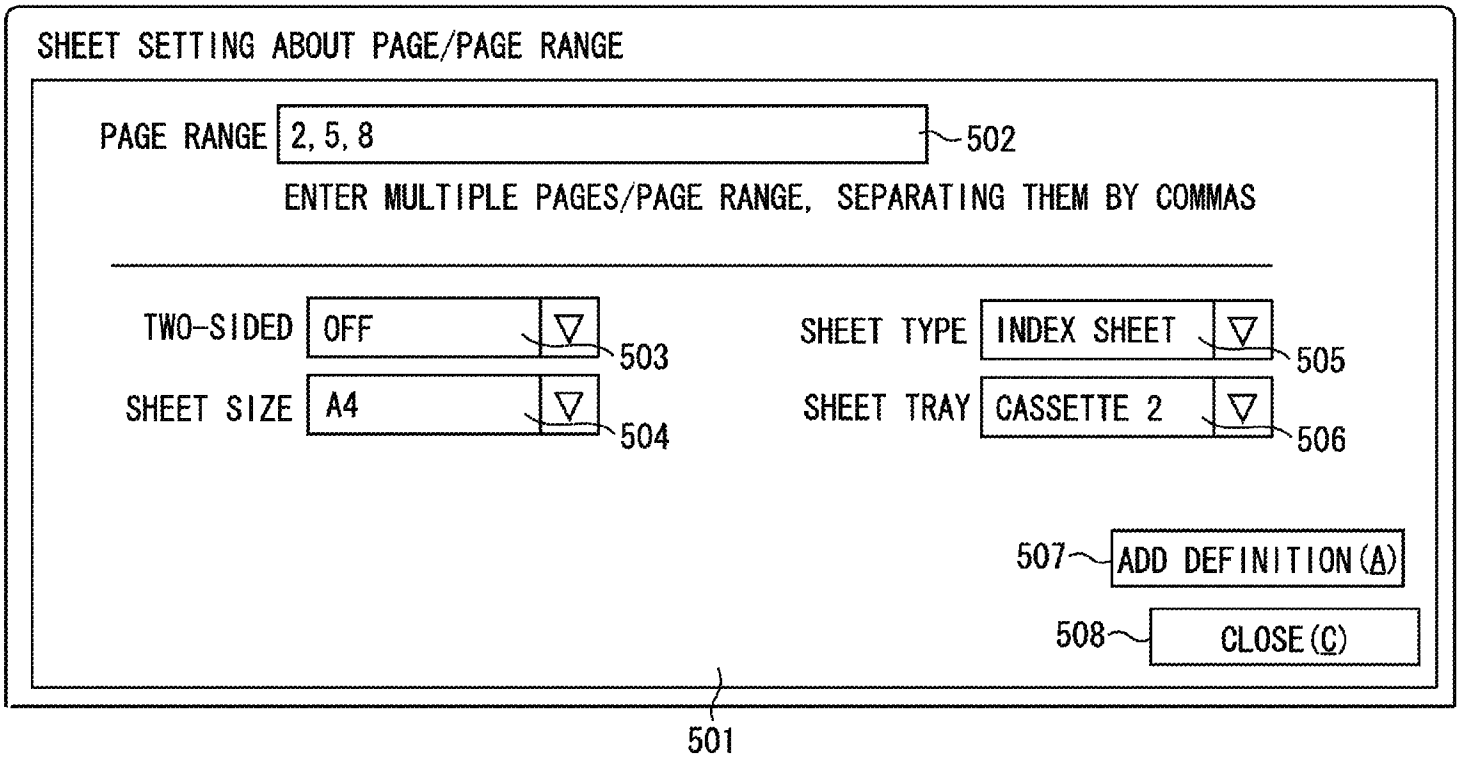
FIG. 5 illustrates a UI displayed on the computer terminal illustrated in FIG. 1.

FIGS. 4 and 5 each illustrate an example of a user interface displayed on a display apparatus of the computer terminal 103 illustrated in FIG. 1. More specifically, FIG. 4 illustrates an example of a screen on which a user sets sheets to be used in the print job which the printer driver displays on the display apparatus, and FIG. 5 illustrates an example of a screen on which a user specifies the sheet settings about page/page range.

Referring to FIG. 4, a page setting box 401 is a field to display the settings of a size, a type, one-sided or two-sided printing, and a sheet tray of a sheet to be used for each page. The row indicated as "BODY" shows the settings of whole print documents. The row indicated as "2, 5, 8" shows exceptional settings that do not comply with the settings for the body.

In the example illustrated in FIG. 4, pages 2, 5, and 8 are set so that the two-sided mode is OFF, the type of sheets is index sheet, the size of sheets is A4, and the tray is the cassette 2. These exceptional settings are specified by a page range definition button 402. When a user presses the page range definition button 402, the printer driver displays a page/page range sheet setting screen 501 illustrated in FIG. 5.

A page range setting box 502 is an entry field where a user specifies exceptional pages as illustrated in FIG. 4 (pages 2, 5, 8 are specified as the exceptional pages in the screen illustrated in FIG. 4).

A two-sided mode setting box 503 is a field where a user sets whether to turn on or off the two-sided mode. A sheet size setting box 504 is a field where a user sets a size of sheets to be used. A sheet type setting box 505 is a field where a user sets a type of sheets. A sheet tray setting box 506 is a field where a user sets a sheet tray. When a user presses a definition addition button 507 after specifying the settings, the specified settings are reflected to the page setting box 401. Pressing a close button 508 returns the screen to the sheet setting screen illustrated in FIG. 4.

When a user issues a print instruction from the printer driver after completion of these settings, the printer driver inputs a print job to the printing apparatus 101 according to the settings of the page setting box 401.

The printing method of the present exemplary embodiment will be described below. This printing method includes printing a first set of documents while counting the number of tab sheets to be used in the first set of documents, discharging surplus tab sheets after completion of printing of the first set of documents, and in printing of second and any following sets of documents, discharging surplus tab sheets subsequent to discharging the same number of tab sheets as the number of tab sheets used in the first set of documents.

Figure 6:
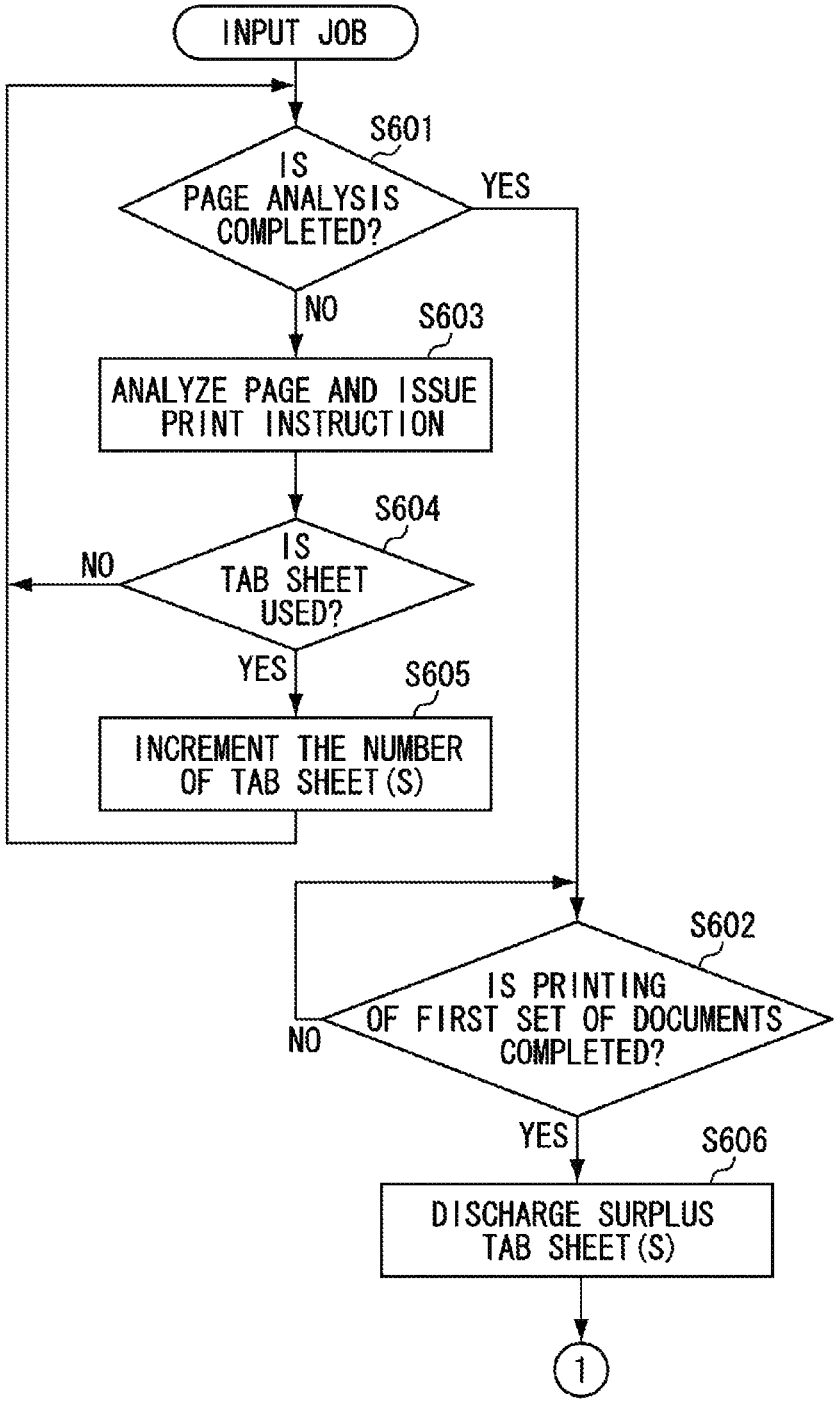
FIG. 6 is a flowchart illustrating job processing of the printing apparatus.
Figure 7:
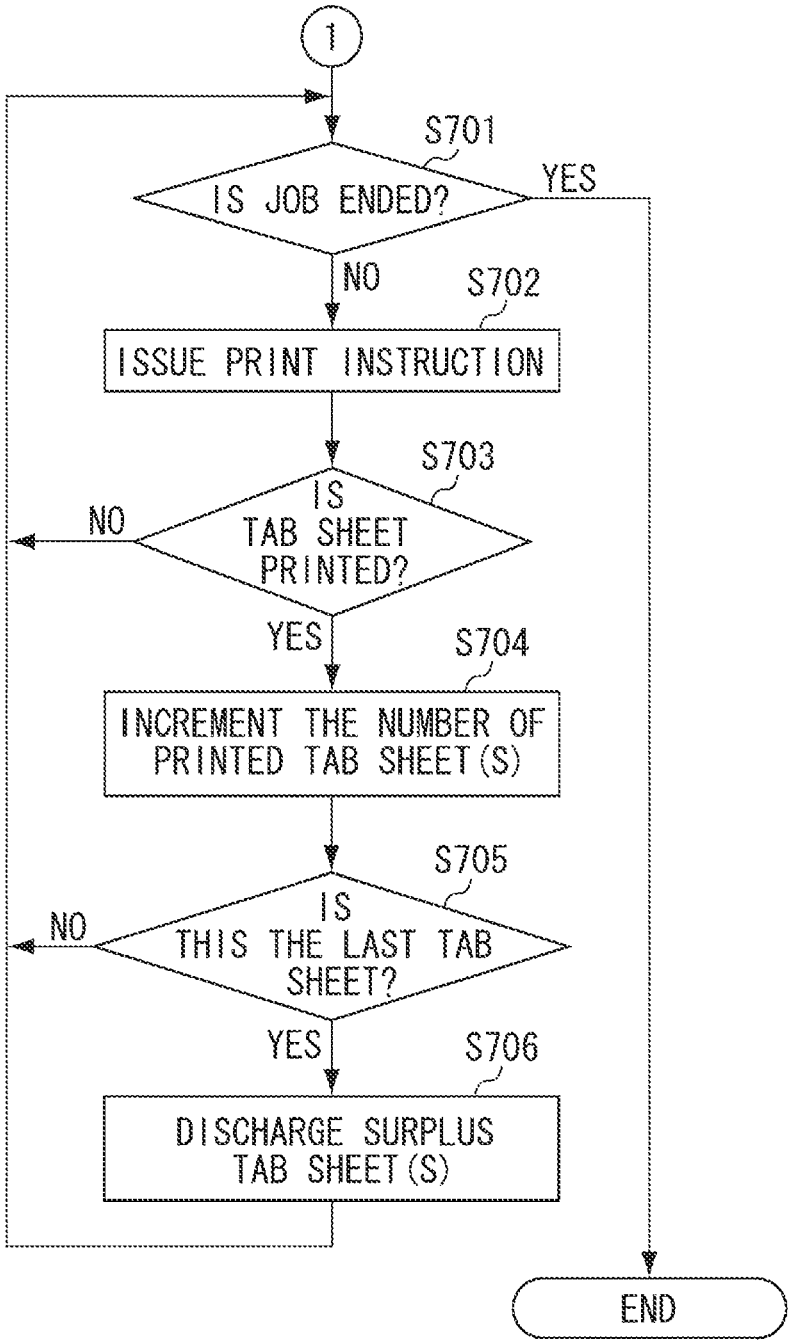
FIG. 7 is a flowchart illustrating the job processing by the printing apparatus.

FIGS. 6 and 7 are flowcharts illustrating job processing performed by the printing apparatus according to the present exemplary embodiment. The MFP control unit 201 loads a control program from the ROM or a hard disk (HDD) to the RAM to execute it, thereby realizing the steps S601 to S606, and S701 to S706. FIG. 6 is a flowchart illustrating printing of a first set of documents.

In the following, a description will be given of how the MFP control unit 201 controls a printing operation after feeding the last tab sheet to be fed during printing the number document sets for one print job. More specifically, a description will be given of an example in which, consecutively after feeding of the last tab sheet to be used for one job, the MFP control unit 201 feeds tab sheets remaining from the number of the used tab sheets in a plurality of tab sheets constituting one tab sheet set (refer to FIG. 9). The printer unit 108 performs printing in parallel with the processing illustrated in FIGS. 6 and 7, according to the instruction from the MFP control unit 201.

The NIC/RIP unit 202 receives a print job transmitted from the computer terminal 103 via the network 102, by using a receiving buffer provided in, for example, the RAM included in the MFP control unit 201. At this time, the MFP control unit 201 starts a page analysis by using of the NIC/RIP unit 202.

Then, in step S601, the MFP control unit 201 determines whether the NIC/RIP unit 202 completes the page analysis of the print job. In step S601, if the MFP control unit 201 determines that the NIC/RIP unit 202 completes the page analysis (YES in step S601), the processing proceeds to step S602. Then, in step S602, the MFP control unit 201 determines whether printing of a first set of documents is completed. The details of step S602 will be described below.

On the other hand, in step S601, if the MFP control unit 201 determines that the NIC/RIP unit 202 has not completed the page analysis yet (NO in step S601), the processing to step S603. Then, in step S603, the MFP control unit 201 performs the page analysis with use of the NIC/RIP unit 202. When the NIC/RIP unit 202 completes an analysis of a page to be printed on one sheet based on the information of the analyzed page, the MFP control unit 201 transmits the image data of the page and an instruction to print the data to the printer unit 108 via the output image processing unit 204.

This print instruction contains instructions specifying a print appearance such as an instruction to print the data in the one-side or two-side mode, and an instruction to print the data in a reduction layout. The printer unit 108 prints the page received from the MFP control unit 201 so as to satisfy the instructed print appearance.

Next, in step S604, the MFP control unit 201 determines whether the page analyzed in step S603 is printed with use of a tab sheet. If the MFP control unit 201 determines that the page is printed without use of a tab sheet (NO in step S604), the processing proceeds to step S601.

On the other hand, in step S604, if the MFP control unit 201 determines that the page is printed with use of a tab sheet (YES in step S604), the processing proceeds to step S605. In step S605, the MFP control unit 201 increments the number of tab sheets to be used in one document set, and stores the incremented value in the memory unit 203. After that, the processing returns to step S601.

Further, after the MFP control unit 201 determines in step S601 that the MFP control unit 201 completes analyses of all pages in one document set, in step S602, the MFP control unit 201 determines whether printing of the first set of documents is completed. The printer unit 108 continues the printing processing of the first set of documents according to the instruction received from the MFP control unit 201 in step S603, in parallel with execution of the process of step S602 by the MFP control unit 201.

After that, in step S602, if the MFP control unit 201 determines that the printer unit 108 completes the printing of the first set of documents (YES in step S602), the processing proceeds to step S606. In step S606, the MFP control unit 201 discharges surplus tab sheets that are not used for the printed first set of documents.

At this time, if the number of tab sheets placed on the sheet feeding cassette 104 of the MFP 101 is not an integral multiple of the number of tab sheets to be used for one set of documents, which the MFP control unit 201 stores in the memory unit 203, the MFP control unit 201 consecutively discharges the surplus tab sheets so as to realize an integral multiple.

The printing of the second and subsequent sets of documents will be described with reference to FIG. 7. In step S701, the MFP control unit 201 determines whether the job is completed. If the MFP control unit 201 determines that the job is completed (YES in step S701), the processing is ended.

On the other hand, in step S701, if the MFP control unit 201 determines that the job is not completed yet (NO in step S701), the processing proceeds to step S702. In step S702, the MFP control unit 201 issues a print instruction to the printer unit 108 via the output image processing unit 204. Next, in step S703, the MFP control unit 201 determines whether the sheet printed in step S702 is a tab sheet. If the MFP control unit 201 determines that the printed sheet is not a tab sheet (NO in step S703), the processing proceeds to step S701.

On the other hand, in step S703, if the MFP control unit 201 determines that the printed sheet is a tab sheet (YES in step S703), the processing proceeds to step S704. Then, in step S704, the MFP control unit 201 increments the number of printed tab sheets. In step S705, the MFP control unit 201 determines whether the sheet printed in step S702 is the last tab sheet in the current document set. More specifically, the MFP control unit 201 determines whether the printer unit 108 prints tab sheets of the number corresponding to the number of tab sheets counted during the printing of the first set of documents.

In step S705, if the MFP control unit 201 determines that the printed tab sheet is not the last tab sheet (NO in step S705), the processing returns to step S701. On the other hand, in step S705, if the MFP control unit 201 determines that the printed sheet is the last tab sheet (YES in step S705), the processing proceeds to step S706.

Then, in step S706, the MFP control unit 201 consecutively discharges surplus tab sheets, and after that, the processing returns to step S701. The number of the surplus tab sheets is the same as that for the first set of documents, and therefore the MFP control unit 201 discharges the same number of sheets as the one determined in step S606.

In the first exemplary embodiment, the printing is performed while analyzing a page. A second exemplary embodiment will be described employing a case where printing is performed after completing the analysis of all pages, such as the case of reverse order printing. In other words, this is an example in which the number of tab sheets to be used in one set of documents can be known before starting to print a first set of documents.

Figure 8:
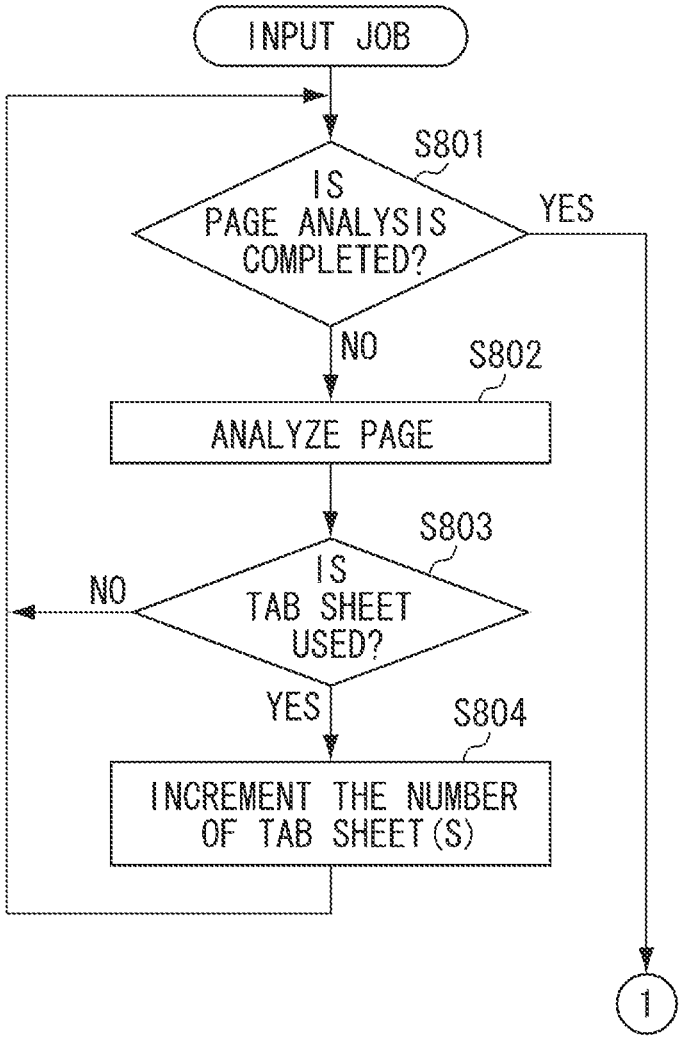
FIG. 8 is a flowchart illustrating job processing by the printing apparatus.

FIG. 8 is a flowchart illustrating job processing in the printing apparatus according to the present exemplary embodiment. The MFP control unit 201 loads a control program from the ROM or the hard disk (HDD) to the RAM to execute it, thereby realizing the steps S801 to S804.

The MFP control unit 201 stores a print job transmitted from the computer terminal 103 via the network 102 and received via the NIC/RIP unit 202, in the receiving buffer provided in, for example, the RAM. At this time, the MFP control unit 201 starts a page analysis by using the NIC/RIP unit 202.

Then, in step S801, the MFP control unit 201 after receiving the print job determines whether the page analysis is completed. In step S801, if the MFP control unit 201 determines that the page analysis is completed (YES in step S801), the processing proceeds to step S701.

On the other hand, in step S801, if the MFP control unit 201 determines that the page analysis is not completed yet (NO in step S801), the processing proceeds to step S802. Then, in step S802, the MFP control unit 201 performs a page analysis by using the NIC/RIP unit 202. Next, in step S803, the MFP control unit 201 determines based on the analysis result performed in step S802 whether this page uses a tab sheet. In step S803, if the MFP control unit 201 determines that this page does not use a tab sheet (NO in step S803), the processing returns to step S801.

On the other hand, in step S803, if the MFP control unit 201 determines that this page uses a tab sheet (YES in step S803), the processing proceeds to step S804. Then, in step S804, the MFP control unit 201 increments the number of tab sheets to be used for one set of documents, and store the incremented value in the memory unit 203.

In this way, after completion of all of the page analyses, the processing illustrated in the flowchart of FIG. 7 is started. The processing illustrated in FIG. 7 is the same as that in the first exemplary embodiment, and therefore the description thereof will be omitted.

Figure 9:
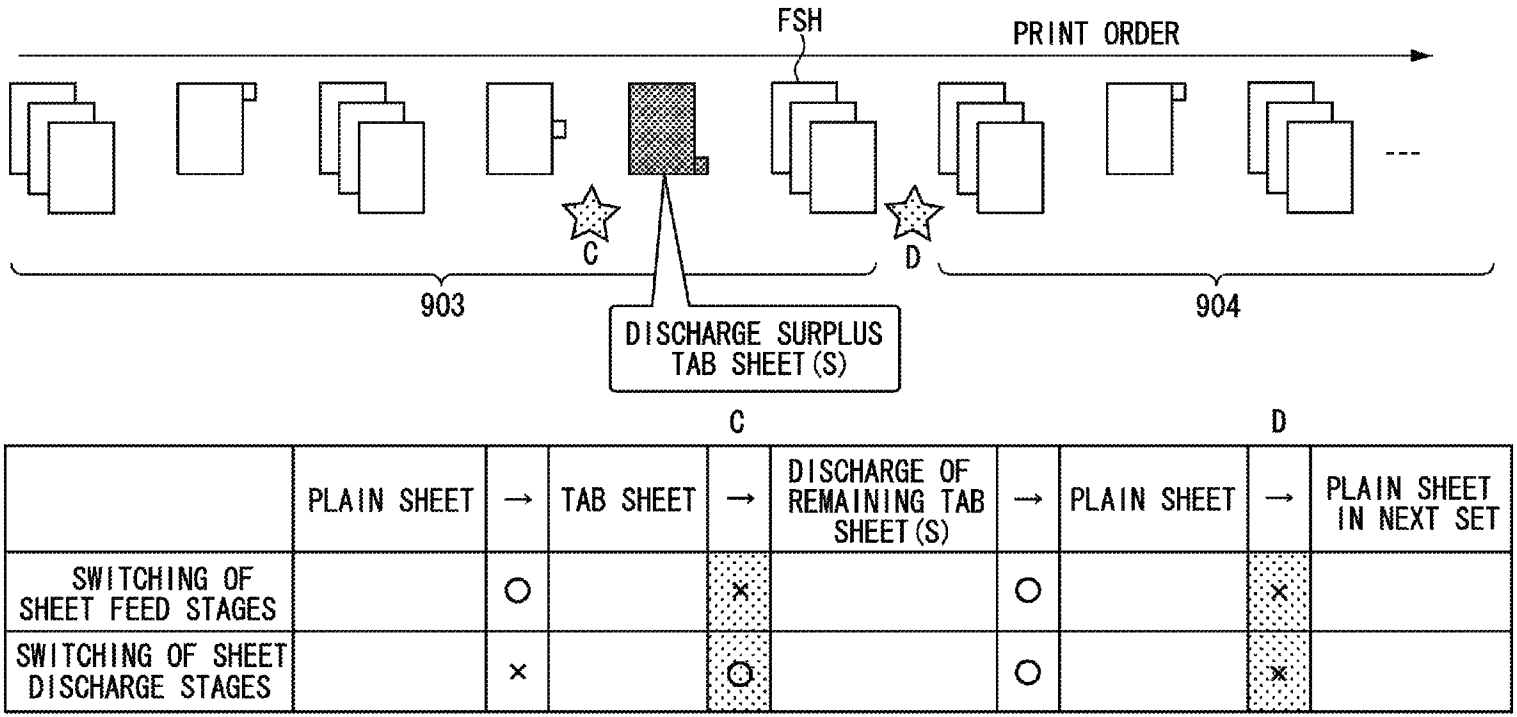
FIG. 9 illustrates how the printing apparatus performs the job processing.

Execution of control as illustrated according to the first or second exemplary embodiment enables, for example, the tab sheet discharge control as illustrated in FIG. 9.

FIG. 9 illustrates how the printing apparatus according to the above-described exemplary embodiments processes a print job. The example illustrated in FIG. 9 indicates the order in which sheets are discharged in printing a plurality of document sets, each of which is a job containing nine pages.

Referring to FIG. 9, "FSH" are remaining tab sheets, which are the surplus sheets other than the used tab sheets in a set of a plurality of tab sheets, to be fed consecutively after a discharge of the last tab sheet used for one job. The sheets FSH are sheets corresponding to the last document set.

Figure 10:
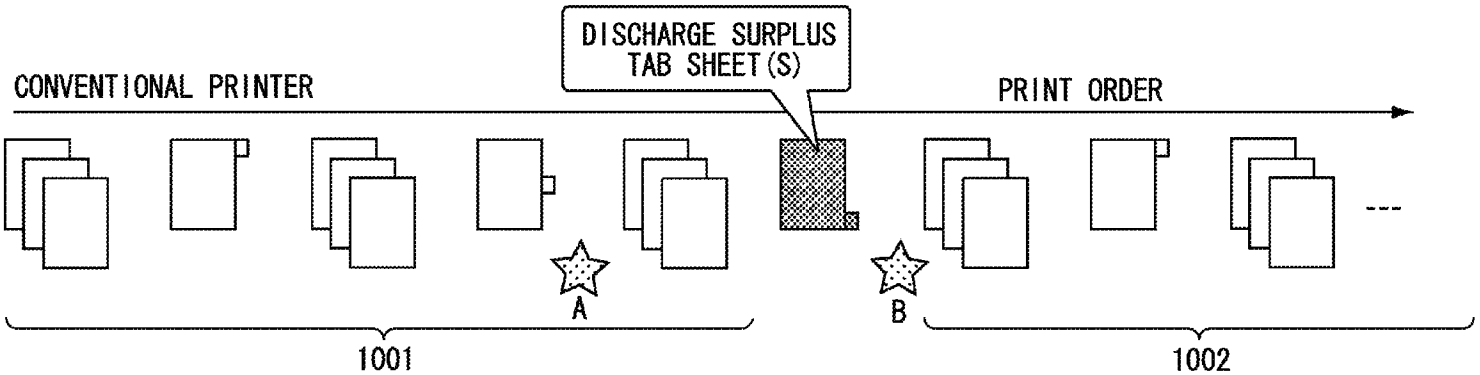
FIG. 10 illustrates how a conventional printing apparatus performs job processing.

In this way, discharging a surplus tab sheet immediately after a lastly fed tab sheet can reduce the number of times of switching the sheet feed stages, compared to the conventional job processing illustrated in FIG. 10. Therefore, it is possible to reduce the number of times of processing for changing the sheet conveyance path required for switching the sheet feed stage, and the number of times of processing for securing the interval time between conveyance of a tab sheet and conveyance of plain sheets to prevent occurrence of a jam, thereby restraining a deterioration in the productivity as much as possible.

The exemplary embodiments have been described based on the example of determining whether a tab sheet is printed in step S703 and incrementing the number of printed tab sheets in step S704. However, the exemplary embodiments may be configured in such a manner that it is determined in step S703 whether a tab sheet is fed, and the number of fed tab sheets is incremented in step S704. In other words, tab sheets may be fed merely to be inserted between sheets other than tab sheets, and may be used without any image printed thereon.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention. In an example, a computer-readable medium may store a program that causes a printing apparatus to perform a method described herein. In another example, a central processing unit (CPU) may be configured to control at least one unit utilized in a method or apparatus described herein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-151227 filed Jul. 1, 2010, which is hereby incorporated by reference herein in its entirety.

What is claimed is:

1. A printing apparatus, comprising:

a printing unit configured to print images on sheets;

an inserting unit configured to insert, to the sheets, at least one tab sheet from among one set of tab sheets;

a specifying unit configured to specify a number of tab sheets to be inserted to one copy of sheets on which images are printed by the printing unit; and a discharging control unit configured to perform control to discharge from the printing apparatus, following a last tab sheet included in the tab sheets of the number specified by the specifying unit, a surplus tab sheet which has not been inserted by the inserting unit and then perform control to discharge a remaining sheet included in the one copy of sheets from the printing apparatus after the tab sheets of the number specified by the specifying unit have been inserted to the one copy of sheets.

2. The printing apparatus according to claim 1, further comprising:

a receiving unit configured to receive a print job for printing images on the one copy of sheets; and an analyzing unit configured to analyze the print job, wherein the specifying unit specifies the number of tab sheets according to a result of the analysis by the analyzing unit.

3. The printing apparatus according to claim 2, wherein the printing unit starts the printing after the analyzing unit completes the analysis of the print job.

4. The printing apparatus according to claim 2, wherein the printing unit performs the printing in parallel with the analysis by the analyzing unit.

5. A control method for controlling a printing apparatus, the control method comprising:

printing images on sheets;

inserting, to the sheets, at least one tab sheet from among one set of tab sheets;

specifying a number of tab sheets to be inserted to one copy of sheets on which images are printed; and performing control to discharge from the printing apparatus, following a last tab sheet included in the tab sheets of the number specified by the specifying unit, a surplus tab sheet which has not been inserted and then performing control to discharge a remaining sheet included in the one copy of sheets from the printing apparatus after the tab sheets of the specified number have been inserted to the one copy of sheets.

6. A non-transitory computer-readable storage medium storing a program for controlling a printing apparatus to perform a method, the method comprising:

printing images on sheets;

inserting, to the sheets, at least one tab sheet from among one set of tab sheets;

specifying a number of tab sheets to be inserted to one copy of sheets on which images are printed; and performing control to discharge from the printing apparatus, following a last tab sheet included in the tab sheets of the number specified by the specifying unit, a surplus tab sheet which has not been inserted and then performing control to discharge a remaining sheet included in the one copy of sheets from the printing apparatus after the tab sheets of the specified number have been inserted to the one copy of sheets.

* * * * *